US005837925A

United States Patent [19]

Nice

[11] Patent Number: 5,837,925

[45] Date of Patent: Nov. 17, 1998

[54] SHAPED CHARGE RETAINER SYSTEM

[75] Inventor: Sidney B. Nice, Olney, Ill.

[73] Assignee: Western Atlas International, Inc., Houston, Tex.

[21] Appl. No.: 571,510

[22] Filed: Dec. 13, 1995

[51] Int. Cl.[6] ..... F42B 1/02; F42D 3/00; C06C 5/04

[52] U.S. Cl. ..... 102/310; 102/312; 102/313; 102/275.7; 102/275.11; 102/275.12

[58] Field of Search ..... 102/312, 313, 102/275.7, 275.11, 275.12, 310

[56] References Cited

U.S. PATENT DOCUMENTS

| | | | |
|---|---|---|---|
| 4,034,673 | 7/1977 | Schneider, Jr. | 102/56 HC |
| 4,126,092 | 11/1978 | Cross | 102/24 HC |
| 4,191,265 | 3/1980 | Bosse-Platiere | 175/4.56 |
| 4,856,430 | 8/1989 | Gibb et al. | 102/307 |
| 4,901,619 | 2/1990 | Sassmannshausen et al. | 86/20.12 |

FOREIGN PATENT DOCUMENTS

| | | | |
|---|---|---|---|
| 2228785 | 3/1989 | United Kingdom | 102/275.7 |
| 2252605 | 8/1992 | United Kingdom | 102/310 |

*Primary Examiner*—Peter A. Nelson
*Attorney, Agent, or Firm*—Alan J. Atkinson

[57] ABSTRACT

An apparatus and method for retaining shaped charges. A foam core having charge carrying recesses can be constructed from a single piece or from multiple sections. Shaped charges are insertable within the foam core recesses so that the shaped charges are proximate to a detonator cord positioned inside or outside of the foam core. The foam core assembly holding the detonator cord and shaped charges is inserted into a housing such as a cylindrical tubing to construct the perforating gun. A seal isolates the shaped charges from pressurized well fluids. The housing can be attached to a firing head and lowered to the desired depth in a well casing. Additional foam sections can be added to modify the number and orientation of the shaped charges. The invention is particulaly useful with thin housing material and substantially reduces the manufacturing cost of perforating guns.

20 Claims, 3 Drawing Sheets

SHAPED CHARGE RETAINER SYSTEM

BACKGROUND OF THE INVENTION

The present invention relates to the field of shaped charges for perforating casing in hydrocarbon producing wells. More particularly, the present invention relates to a foam core for retaining shaped charges within a tubular housing.

Well casing is typically installed in boreholes drilled into subsurface geologic formations. The well casing prevents uncontrolled migration of subsurface fluids between different well zones and provides a conduit for installing production tubing in the well. The well casing also facilitates the running and installation of production tools in the well.

To produce hydrocarbon fluids from a subsurface formation, the well casing is punctured by multiple shaped charges in a perforating gun. The perforating gun includes a firing head which is actuated to detonate a primary explosive and to ignite a booster charge connected to a primer or detonator cord. The detonator cord transmits a detonation wave to each shaped charge. Booster charges within each shaped charge activate explosive material within the charges which collapse the shaped charge liner. Each liner generates a high velocity jet for penetrating the well casing and the surrounding geologic formations. Such jets perforate the well casing and establish a flow path for the hydrocarbon fluids from the subsurface geologic formations to the interior of the well casing. In a well having multiple production zones, packers can isolate selected zones of the well casing, and production tubing transports the hydrocarbon fluids from such zones to the well surface.

Perforating gun firing heads can be actuated by mechanical, hydraulic or electrical mechanisms. Multiple shaped charges are closely positioned within perforating guns to maximize the number of well casing perforations created within the well casing. In one type of perforating gun, the shaped charges are fastened to a metallic string and are lowered into the borehole. In another type of perforating gun, the shaped charges are isolated from pressurized well fluids by a metallic housing having threaded ports machined into the housing wall. Fittings are rotated into each port and a shaped charge is positioned to fire through each port. Although such perforating guns can be used for multiple wells, the gun housings require heavy metal tubulars and expensive machining modifications.

Various efforts have been made to reduce the cost of perforating guns without affecting the integrity of the shaped charges. For example, perforating guns have been constructed from thin wall tubular housing sections attached with expandable slip systems. Shaped charges are retained within the housing sections with metal spiders, brackets, metal strips, and other fastening systems to orient the shaped charges in a fixed position relative to the gun housing interior. Such fastening systems require extensive labor to install the shaped charges. Additionally, components of such fastening systems are destroyed by the detonation of the shaped charges and leave residue within the well casing. This perforating gun residue is undesirable and can interfere with well producing operations.

Accordingly, a need exists for a shaped charge retainer system that retains shaped charges in a selected orientation and that isolates the shaped charges from pressurized fluids. The retainer system should withstand the well conditions without failure, should retain the shaped charges in a selected position, and should be easy to manufacture and use.

SUMMARY OF THE INVENTION

The present invention provides an apparatus and method for retaining a shaped charge, ignitable by a detonator cord, within a housing which can be lowered into a well. The apparatus includes a foam core insertable within the housing. A recess in the foam core retains the shaped charge. A hole in the foam core permits engagement between the detonator cord and the shaped charge.

In other embodiments of the invention, the foam core can be formed in two adjacent sections to facilitate placement of the detonator cord, and an additional foam core can be positioned acjacent to the first foam core to increase the number of shaped charges within the housing. The exterior surface of the foam core can substantially conform to the inner wall surface of the housing or can be configured to stand off from such inner wall surface with ribs or other protrusions. A seal can be positioned within an open end of the housing to isolate the shaped charges from the well casing interior.

The method of the invention is practiced by positioning a foam core adjacent the housing, by placing a detonator cord proximate to the foam core, by inserting a shaped charge in a recess within the foam core, and by inserting the foam core, detonator cord and shaped charge into the open end of the housing.

DESCRIPTION OF THE PREFERRED EMBODIMENTS

Figure 1:
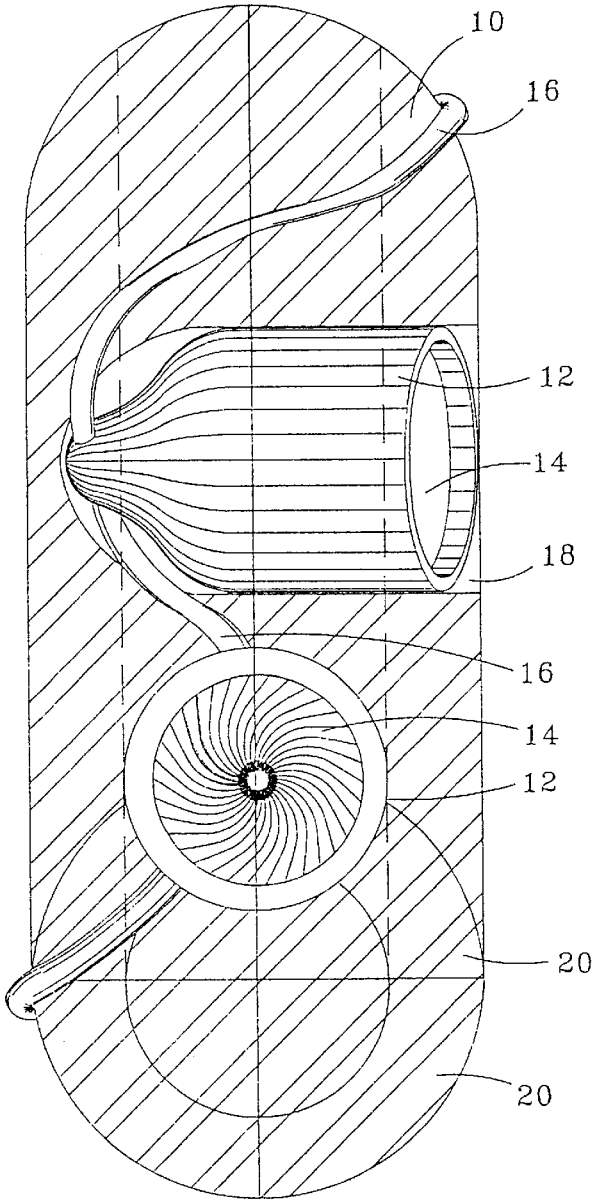
FIG. 1 illustrates an elevation view of a foam core section showing shaped charge recesses oriented at a ninety degree relative angle.

The present invention provides a unique retainer for shaped charges in a perforating gun. Referring to FIG. 1, foam core 10 has recesses 12 for containing shaped charges 14. Detonator cord 16 is engaged with shaped charges 14 and is positioned within hole 18 of foam core 10. Foam core 10 is illustrated as having a substantially cylindrical exterior surface which can conform to the interior wall surface of a cylindrical housing as described more thoroughly below. Although the exterior surface of foam core 10 can be substantially cylindrical as shown in FIG. 1, such surface could be indented or formed in different geometrical shapes sufficient to be inserted within the housing.

Although foam core 10 could be constructed as a single piece, one alternative embodiment of foam core 10 is shown in FIG. 1 wherein two or more foam core sections 20 are positioned adjacent to the other to create foam core 10. By constructing foam core 10 with two or more core sections 20, the installation of detonator cord 16 and of shaped charges 14 within foam core 10 can be facilitated. The contact between foam core sections 20 can exist along a substantially flat plane parallel to a longitudinal axis of the housing illustrated in FIG. 1, or could comprise other shapes.

Hole 18 can extend through one or both of core sections 20 to retain detonator cord 16 inside or outside of foam core 10. Hole 18 of a plurality of holes 18 can each define a cavity, an opening, perforation, void, gap or aperture in foam core 10 sufficient to permit engagement between shaped charges 14 and detonator cord 16. Hole 18 can be substantially located within foam core 10 to retain detonator cord 16 within foam core 10. For alternative embodiments of the invention wherein detonator cord 16 is positioned outside of foam core 10, hole 18 can comprise an opening adjacent shaped charge 14 for permitting engagement between shaped charge 14 and detonator cord 16. Hole 18 can be configured to permit a portion of shaped charge 14 to extend through hole 18 so that shaped charge 14 protrudes outside of foam core 10.

Figure 2:
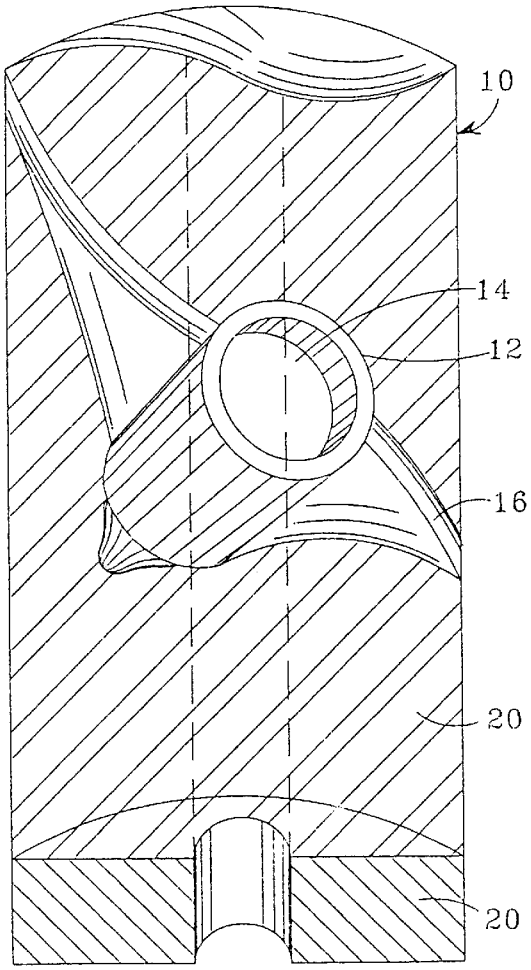
FIG. 2 illustrates a schematic view of a shaped charge recess oriented within two adjacent foam core sections.

Each core section 20 can be a mirror image of the other core section 20. Alternatively, each core section can be constructed with different shapes sufficient to facilitate the placement of detonator cord 16 and shaped charge 14. As shown in FIG. 2, one orientation of recess 12 is illustrated before the insertion of shaped charge 14. FIG. 2 illustrates another feature of the invention wherein the lengths of core sections 20 are offset so that additional core sections 20 can be added to extend the total length of foam core 10. Such offset of core sections 20 can be designed to maintain the desired longitudinal spacing between shaped charges 14 on adjacent core sections 20. In this fashion, the shot pattern for a plurality of shaped charges 14 can be controlled.

Foam core 10 can be fabricated from polyethylene, polystyrene, styrofoam, plastic, pulp material, or any organic, inorganic, or metallic material having the desired characteristics. The term "foam" as used herein includes without limitation all of these different materials which are suitable for forming or constructing foam core 10. Foam core 10 can be formed as a composite of different materials or can be homogeneous in composition. In a preferred embodiment of the invention, foam core 10 is formed with a material is pulverized or disintegrated upon the detonation of shaped charges 14 so that discernable residue does not remain within the wellbore after the perforating gun is fired.

Figure 3:
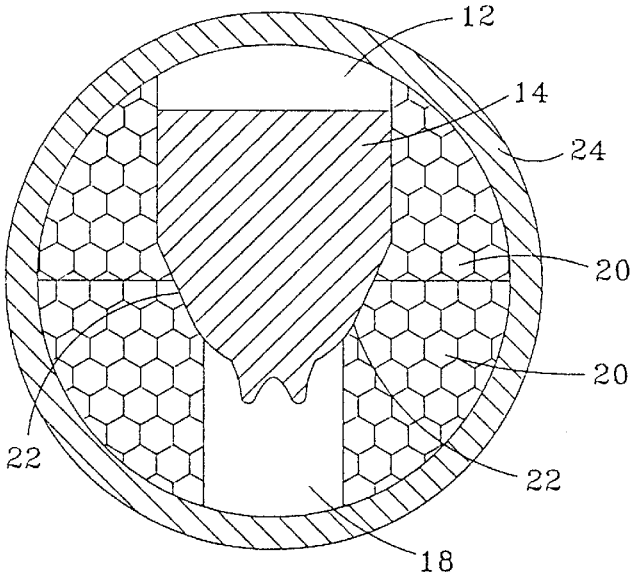
FIG. 3 illustrates an end view of a shaped charge within the recess of a foam core.

Referring to FIG. 3, core sections 20 are semicircular and are illustrated as having substantially flat surfaces in contact with the other. The contact between core sections 20 does not have to be planar but could exist along certain contact points. Additionally, such contact could be along a curved plane or other defined shaped to establish the desired orientation of each core section 20 relative to the other.

The dimensions of recess 12 are selected to provide a snug fit with shaped charge 14. In one embodiment of the invention, the diameter of recess 12 can be slightly smaller than the outside dimension of shaped charge 14. Because of the compressibility of the foam forming core sections 20, shaped charge 14 can be inserted into recess 12 so that the restoring force provided by the foam acts against shaped charge 14 to resist movement of shaped charge 14.

Recess 12 can be shaped in different ways to accomplish the desired contact with shaped charge 14. For example, recess 12 can have beveled shoulders 22 which mate against shaped charge 14. In this embodiment, shoulders 22 position shaped charge 14 at a selected position relative to the exterior surface of foam core 10. In one embodiment of the invention as illustrated in FIG. 3, recess 12 can extend through foam core 10 so that shaped charge 14 is accessible from two different sides. In this embodiment, the liner side of shaped charge 14 is open to cylindrical housing 24, and the booster side of shaped charge 14 is accessible to facilitate the engagement of detonator cord 16 with shaped charge 14.

Figure 4:
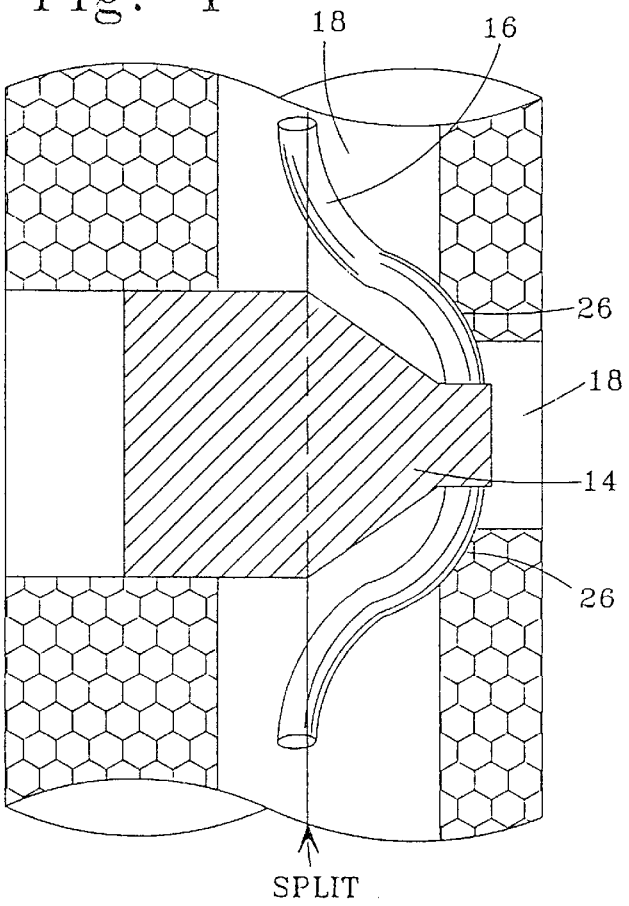
FIG. 4 illustrates a side view of a shaped charge within the recess of a foam core.

As shown in FIG. 4, hole 18 can extend through foam core 10 to permit the installation of detonator cord 16 within foam core 10. In one embodiment of the invention, foam core 10 can be formed with contact points 26 for contacting detonator cord 16 and for providing a friction contact retaining detonator cord 16 in a fixed position relative to shaped charge 14. This configuration provides a similar function to that provided by shoulders 22 in FIG. 3.

Figure 5:
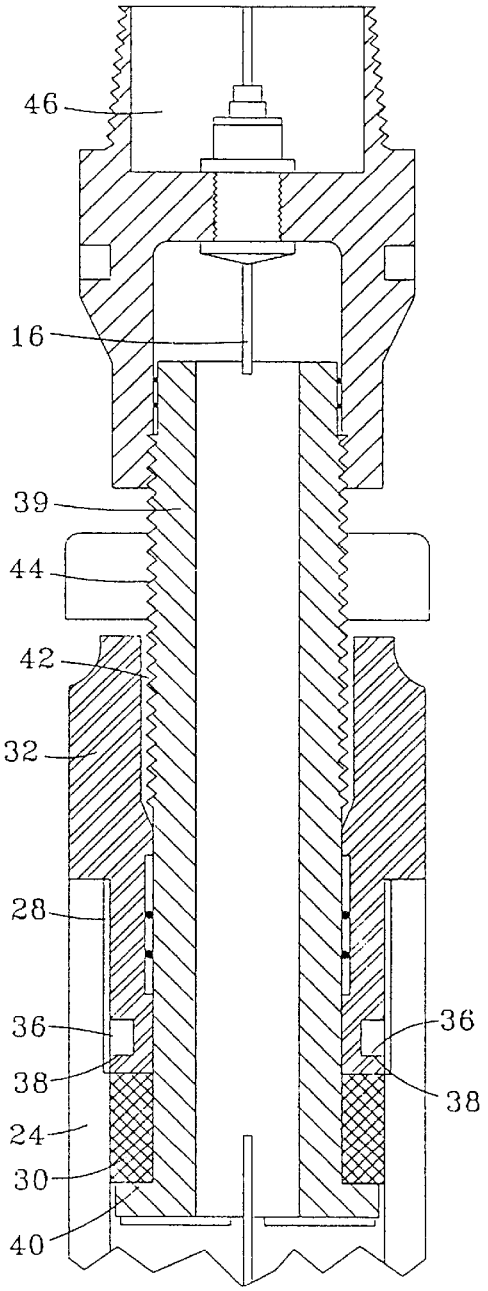
FIG. 5 illustrates a seal and packing mechanism for closing an open end of a cylindrical housing.

The unique configuration of the invention permits housing 24 to be formed or constructed from a material having a thickness less than conventional perforating gun housings. Consequently, the weight and cost of housing 24 is less than conventional housings. Housing 24 may be too thin to permit the conventional use of packing slips or mechanical threads to provide attachment with a firing head. Referring to FIG. 5, housing 24 has open end 28 closed with seal 30. Seal 30 comprises a packing material or sealing element which can be energized or set with anchor 32 and mandrel 34.

Anchor 32 is attached to housing 24 with pins or bolts 36 inserted through apertures 38 in the wall of housing 24. Pins 36 prevent longitudinal or rotational movement between anchor 32 and housing 24. Mandrel 34 has flange surface 40 for engaging seal 30, and has threads 42 which are engageable with a threadform in nut 44. As nut 44 is rotated, nut 44 contacts anchor 32 and draws flange surface 40 toward anchor 32 to compress seal 30. Such compression urges seal 30 into contact with the inner wall surface of housing 24. Mandrel 34 can also have a threaded engagement with firing head 46 so that a mechanical connection is provided between housing 24 and firing head 46. This mechanical connection is provided without requiring substantial machining of cylindrical housing 24.

As shown in FIG. 5, detonator cord 16 extends from firing head 46 through seal 30 into foam core 10. Seal 30 isolates foam core 10 and the encapsulated shaped charges 14 from well fluids and from the pressure in the well bore. Although the configuration of seal 30, anchor 32 and mandrel 34 is-believed to be unique, other different sealing systems can accomplish the functional result accomplished by seal 30 and the mechanical system shown for energizing seal 30.

Figure 6:
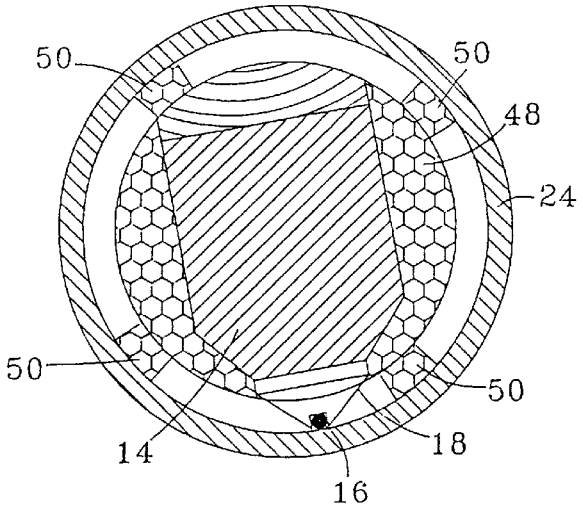
FIG. 6 illustrates ribs for centering a foam core in a cylindrical housing.

FIG. 6 illustrates an alternative foam core 48 having protrusions or ribs 50 extending outwardly from the center body of foam core 48. Ribs 50 contact the inner wall of housing 24 and resist longitudinal and rotational movement of foam core 48 relative to housing 24. Ribs 24 also cushion shaped charges 14 from impacts acting against housing 24.

Figure 7:
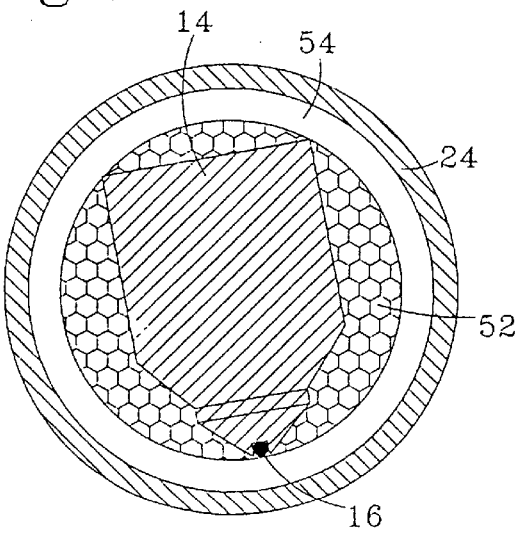
FIG. 7 illustrates an embodiment of the invention wherein the front surface of a shaped charge positions the foam core within a cylindrical housing.

FIG. 7 shows an alternative embodiment of the invention wherein shaped charge 14 is positioned within foam core 52. As shown, foam core 52 is separated from housing 24 by annular gap 54 which facilitates the insertion of foam core 52 into housing 24. Detonator cord 16 is protected within hole 18 which is recessed within the exterior surface of foam core 52.

Figure 8:
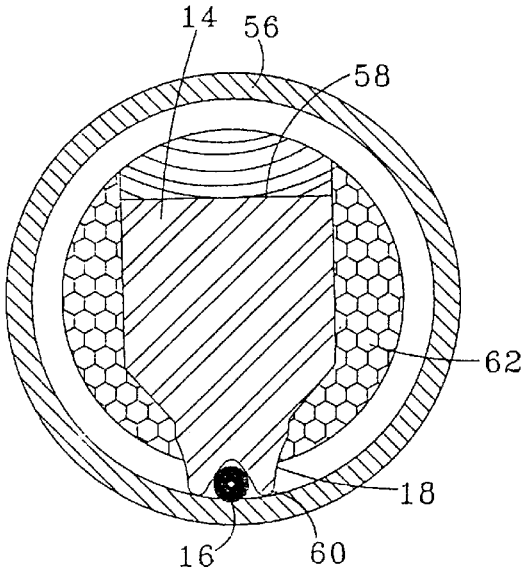
FIG. 8 illustrates an embodiment of the invention wherein the back surface of a shaped charge positions the foam core within a cylindrical housing.

Referring to FIG. 8, shaped charge 14 is positioned within a smaller diameter housing 56 so that the offset distance from the front surface 58 of shaped charge 14 is relatively close to the inner surface of housing 56. Back edge 60 of shaped charge 14 contacts the inner surface of housing 56, so that a combination of shaped charges oriented at ninety degrees, one hundred eighty degrees, or other orientations cooperate to center foam core 62 within housing 56.

Figure 9:
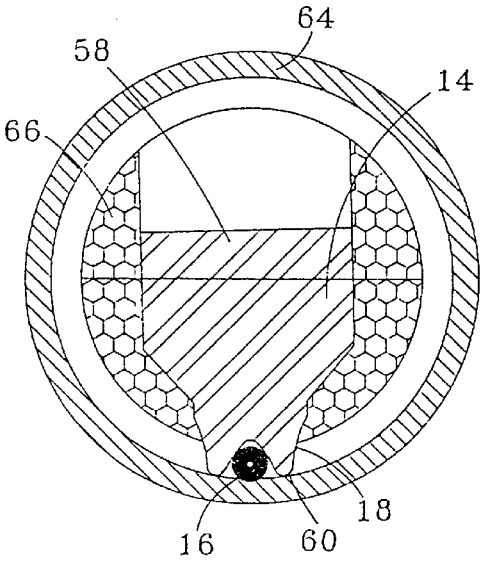
FIG. 9 illustrates an embodiment of the invention wherein the foam core positions a shaped charge with a stand off relative to the inner wall of a cylindrical housing.

FIG. 9 illustrates a similar configuration for shaped charge 14 in a larger housing 64, wherein there is a greater offset between front surface 58 of shaped charge 14 and the inner surface of housing 64. As previously described, additional shaped charges 14 can be oriented to center foam core 66 within housing 64.

Although detonator cord 16 can be positioned within a hole or holes 18 within the foam cores illustrated herein, detonator cord 16 can also be run on the outside surface of the foam cores as shown in FIGS. 6, 8 and 9. This position can facilitate the engagement of detonator cord 16 with shaped charges 14 to reduce the installation time necessary to assemble a perforating gun. As previously described, hole 18 facilitates the engagement of detonator cord 16 with shaped charges 14.

The method of the invention is practiced by positioning foam core 10 adjacent housing 24. One or more shaped charges 14 are inserted in one or more recesses 12, and detonator cord 16 is placed in engagement with shaped charges 14. The foam core, detonator cord 16, and shaped charge 14 are then inserted into an open end of the selected housing to complete the perforating gun.

In other embodiments of the invention, open end 28 of housing 28 is closed with seal 30, firing head 46 can be attached to housing 24, and the firing gun assembly can be lowered into a well casing. Shaped charges 14 can be detonated to perforate the well casing as previously described. Where foam core 10 is formed with two or more core sections 20, each core section 20 can be placed adjacent to housing 24, detonator cord 16 can be placed within hole 18, and the core sections 20 can be positioned adjacent to each other to construct foam core 10. Shaped charges 14 can be placed within recesses 12 before or after the multiple core sections 20 are assembled into foam core 10.

The present invention is readily adaptable to expand the length of foam core 10 and the number of shaped charges 14 within housing 24. After foam core 10 is inserted within housing 24, an additional foam core 10 retaining additional shaped charges 14 can be inserted into housing 24 to extend the length of the original foam core 10. In this fashion, the total length of perforating charges within housing 24 can be extended to any desired length. Moreover, the present invention provides flexibility in placing the shot orientation of shaped charges 14, and in the size and configuration of the shaped charges used. If desired, each shaped charge 14 can be oriented to point the same direction or in a selected orientation within housing 24. For example, all of the shaped charges 14 could be directed downwardly for use in low side perforating operations, or could be oriented in another desired direction or combination of directions.

The present invention provides a flexible, inexpensive shaped charge retainer that can be quickly assembled to create a perforating gun. The structure permits the disassembly and reuse of the components, and readily permits the length of a perforating gun to be extended or reduced.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An apparatus for retaining a shaped charge, ignitable by a detonator cord, within a housing which can be lowered into a well, comprising:

a foam core insertable within the housing;

a recess within said foam core for retaining the shaped charge in a selected position within the housing; and a hole in said foam core for permitting engagement between the detonator cord and the shaped charge.

2. An apparatus as recited in claim 1, further comprising a seal attached to the housing for isolating said foam core within the housing.

3. An apparatus as recited in claim 1, wherein said foam core comprises first and second core sections in contact along a plane parallel to a longitudinal axis of the housing.

4. An apparatus as recited in claim 1, wherein the detonator cord is positioned within said hole.

5. An apparatus as recited in claim 1, wherein the detonator cord is substantially positioned outside of said foam core, and wherein said hole permits the insertion of the shaped charge therethrough to permit engagement between the detonator cord and the shaped charge.

6. An apparatus as recited in claim 1, further comprising a second foam core insertable within the housing at a position adjacent to said foam core.

7. An apparatus as recited in claim 6, wherein said foam core and said second foam core each have shaped ends for relative engagement therebetween.

8. An apparatus as recited in claim 1, further comprising protrusions attached to said foam core for contacting the housing.

9. A perforating gun for retaining shaped charges ignitable by a detonator cord and a firing head, comprising:

a cylindrical housing having an open end;

a foam core insertable within said cylindrical housing;

a plurality of recesses within said foam core for retaining each shaped charge in a selected position within the housing;

at least one hole in said foam core for permitting engagement between the detonator cord and the shaped charges; and a seal attached to said housing for isolating said foam core within said housing.

10. An apparatus as recited in claim 9, further comprising a second foam core insertable within said housing at a location adjacent to said foam core.

11. An apparatus as recited in claim 10, wherein said foam core and said second foam core each have shaped ends for relative engagement therebetween.

12. An apparatus as recited in claim 9, wherein said foam core comprises first and second core sections in contact along a plane parallel to a longitudinal axis of said housing.

13. An apparatus as recited in claim 9, wherein said foam core has an exterior surface which substantially conforms to an inner wall of the cylindrical housing.

14. An apparatus as recited in claim 9, further comprising an aperture through said housing at a position proximate to said housing end, and further comprising a pin engaged with said aperture for retaining the firing head in engagement with said housing.

15. A method for retaining a shaped charge, ignitable by a detonator cord, within a housing having an open end, comprising:

positioning a foam core adjacent the housing, wherein said foam core has a recess for retaining the shaped charge and has a hole for permitting engagement between the shaped charge and the detonator cord;

inserting a shaped charge in said foam core recess;

placing the detonator cord in engagement with the shaped charge through the hole; and inserting said foam core and detonator cord and shaped charge into the open end of the housing.

16. A method as recited in claim 15, further comprising the step of sealing the open end of the housing to isolate the foam core within the housing.

17. A method as recited in claim 15, further comprising the step of inserting an additional shaped charge in a recess within said foam core so that the shaped charges face in different directions.

18. A method as recited in claim 15, further comprising the steps of lowering the housing into a well and of activating the detonator cord to fire the shaped charge.

19. A method as recited in claim 15, wherein said foam core comprises first and second adjacent foam sections, wherein said hole is substantially within said foam core, and further comprising the step of placing the detonator cord in said hole before said second foam section is placed adjacent to said first foam section.

20. A method as recited in claim 15, further comprising the step of inserting a second foam core adjacent to said foam core within the housing.

* * * * *